US005909981A

United States Patent [19]

Neuber, Jr.

[11] Patent Number: 5,909,981

[45] Date of Patent: Jun. 8, 1999

[54] BUMP CUTTING FOR WIDE-POUR CONCRETE FLOORS

[75] Inventor: Joseph F. Neuber, Jr., Kimberton, Pa.

[73] Assignee: Neuber Concrete, A Division of J. F. Neuber Jr. General Contractor, Inc., Kimberton, Pa.

[21] Appl. No.: 08/920,198

[22] Filed: Aug. 25, 1997

[51] Int. Cl.[6] ..... E01C 19/22

[52] U.S. Cl. ..... 404/112; 404/118

[58] Field of Search ..... 404/96, 97, 112, 404/118

[56] References Cited

U.S. PATENT DOCUMENTS 2,900,883 8/1959 Dening ..... 404/112 X
4,702,641 10/1987 Naser et al. .
5,803,658 9/1998 Allen ..... 404/112

*Primary Examiner*—James A. Lisehora
*Attorney, Agent, or Firm*—Peter J. Van Bergen

[57] ABSTRACT

A method and system are provided for finishing a concrete floor that exceeds approximately 50 feet in width. A riding trowel of the type that forms a windrow of loosened concrete material in its wake is positioned on the concrete floor. The riding trowel has a straight edge coupled thereto by a support assembly that positions the straight edge to cross the windrow at a substantially perpendicular angle thereto within line-of-sight of an operator. A power assembly is coupled between the straight edge and the riding trowel for independently controlling vertical and pivoting movement of the straight edge. The riding trowel is driven on the concrete floor and the straight edge is moved along the concrete floor simultaneously with the riding trowel.

13 Claims, 5 Drawing Sheets

BUMP CUTTING FOR WIDE-POUR CONCRETE FLOORS

FIELD OF THE INVENTION

The invention relates generally to concrete floor finishing, and more particularly to a method and system for performing the bump cutting operation in concrete floor finishing especially when the floor is a wide-pour concrete floor in excess of approximately 50 feet in width.

BACKGROUND OF THE INVENTION

The formation of flat or "super flat" concrete floors is the goal of every large construction project. In the construction industry, it is well known that a flat floor will produce a flatness measurement in terms of F(F) numbers in the range of 35–50. Super flat floors, however, will produce F(F) numbers in the range of 50–100. For a detailed description of floor flatness measurements using the industry-standard F-number system, see "Standard Test Method for Determining Floor Flatness and Levelness Using the F-Number System," American Society for Testing and Materials (ASTM) standard designation E 1155.

To achieve flat or super flat concrete floors, the construction industry has for years followed one of two basic methodologies. The first of these will now be explained with the aid of FIG. 1. In FIG. 1, concrete is poured between forms represented by lines 10 and 12 to form a strip 14 of concrete. For reasons that will become apparent below, strip 14 can be up to 50 feet in width but more typically is only 15–30 feet in width and can be as long as the building being constructed (e.g., several hundred feet). Once strip 14 is "struck off" between forms 10 and 12 and has hardened such that only the top ⅛ to 3⁄16 of an inch remains plastic, the finishing of strip 14 to flat or super flat status is begun.

A riding trowel 16 is positioned on strip 14 and driven thereon to stir up the still-plastic top layer of strip 14. Riding trowel 16 is well known in the art and employs rotating finishing blades or pans in contact with strip 14 to support and propel riding trowel 16 on strip 14. The type of finishing blade(s) chosen is based on the degree of hardness of the concrete with the blade(s) being changed as the concrete gets harder. After each pass of riding trowel 16, it is necessary to cut down high areas of concrete and fill low areas with the excess concrete scraped from the high areas. To do this, workers 20 are positioned on either side of strip 14 and are each equipped with a straight edge tool 22 having a handle 24. One such straight edge tool/handle combination is disclosed by Naser et al. in U.S. Pat. No. 4,702,641. Workers 20 manipulate their straight edge tool 22 (using handle 24) back and forth on strip 14 to cut down high areas of concrete and fill the low areas with the scraped concrete from the high areas.

In recent years, a flat disk or pan has been mounted on riding trowel 16 in place of the blades to form a pan machine as it is known. The pan machine accomplishes the function of several types of blades. This has reduced the number of man-hours required for finishing as the pan machine need not even be used until the later phases of hardening. However, this also means that the window of time for proper cutting of high areas and filling of low areas is reduced thereby making the timing of all finishing operations critical.

Each pass of riding trowel 16 (equipped with either blades or pans) also forms one or more windrows, represented by swirled lines 18, in the wake of riding trowel 16. Windrows 18 are small continuous piles of loosened concrete material that are spun out most prominently to the perimeter of the finishing blades (not shown), or between two non-overlapping pans (not shown), mounted and rotating on riding trowel 16. Since windrows 18 are essentially bumps that disrupt the flatness of strip 14 and since the concrete is in its "almost hard" phase, windrows 18 must be cut and smoothed quickly after their formation. To do this, workers 20 manipulate their straight edge tool 22 (using handle 24) back and forth on strip 14 to smooth out windrows 18. To keep up with riding trowel 16, several workers 20 are typically required on either side of strip 14.

This approach to concrete floor finishing has several disadvantages. Super flat floors can only be achieved if workers 20 stay off strip 14. Therefore, the cut/fill operation and the cutting/smoothing of windrows 18 must be accomplished from either side of strip 14 since effective manipulation of straight edge tool 22 is limited to distances of 15–20 feet. In addition, because windrows 18 are being crossed by straight edge tool 22 at angles between 0° and 45°, smaller windrows 19 are continuously created at the outboard ends of straight edge tool 22. Depending on the level of flatness that must be achieved, keeping up with riding trowel 16 can also be a problem as workers 20 may have to work one area of strip 14 more than another. Further, if strip 14 is exposed to a hot sunny environment (as is often the case in summertime floor finishing), windrows 18 can begin to set-up before being cut thereby making the worker's job more difficult or impossible in the worst case scenario.

As mentioned above, the flatness of strip 14 is very important. For this reason, strip 14 is typically only 15–30 feet in width because larger width strips become difficult or impossible to smooth at their centers as workers either cannot reach the center or cannot see what they are doing at the center. Thus, wider width strips (i.e., 30–50 feet) are generally finished at their centers using only riding trowel 16 which limits their flatness to an F(F) number of 30–40 at best. Further, even if the narrower width strips are finished to satisfactory F(F) numbers, adjacent strips necessarily have joints therebetween. These joints can never be finished to the higher F(F) numbers of the strips themselves and therefore will always present potential problems.

Finally, the narrow-width, labor-intensive concrete finishing described above is limited in the amount of concrete that can be finished in a day. In general, an industry-accepted standard is that a crew can finish 9000 square feet per day. However, for large warehouses having 250,000 square feet or more of floor, strip pouring and finishing is not an economical option.

To accommodate large floor construction, the concrete industry in the late 1980's developed a second (now prior art) concrete floor construction that relies on laser screed placement of concrete. In laser screed placement, widths of concrete can exceed 100 feet and recently a pour of 250,000 square feet of concrete was accomplished in a single day. This avoids numerous joints between strips and results in an average cost savings of $1 per square foot. However, these wide-width pours require workers equipped with straight-edge tools to walk on the concrete floor in order to perform the cut/fill operation and the cutting/smoothing of windrows left by the riding trowel. Unfortunately, the damage caused by worker footprints almost offsets the good being achieved by the straight edge tool. Therefore, most contractors rely only on the riding trowel equipped with pans (i.e., a pan machine) to finish a concrete floor that is poured in widths of approximately 50 feet or more. The industry-accepted drawback to finishing only with a riding trowel is a floor flatness that can only achieve an F(F) number in the range of 40–50.

SUMMARY OF THE INVENTION

Accordingly, it is an object of the present invention to provide an improved method and system for finishing wide-width (i.e., in excess of approximately 50 feet) concrete floors.

Another object of the present invention is to provide a method and system for finishing wide-width concrete floors that produces a floor flatness that is comparable to or better than those achieved for narrow-width concrete floors.

Still another object of the present invention is to provide a method and system for finishing wide-width concrete floors that is economically efficient.

Other objects and advantages of the present invention will become more obvious hereinafter in the specification and drawings.

In accordance with the present invention, a method and system are provided for finishing a concrete floor that exceeds approximately 50 feet in width. A riding trowel of the type that forms a windrow of loosened concrete material in its wake is positioned on the concrete floor. The riding trowel has a straight edge coupled thereto by a support assembly. The support assembly positions the straight edge substantially parallel with the concrete floor to cross the windrow at a substantially perpendicular angle thereto within line-of-sight of an operator sitting on the operator seat of the riding trowel. The support assembly simultaneously maintains longitudinal rigidity of the straight edge, permits vertical movement of the straight edge relative to the concrete floor, and permits pivoting movement of the straight edge about its central longitudinal axis. A power assembly is coupled between the straight edge and the riding trowel for independently controlling the vertical movement and the pivoting movement to position the straight edge relative to the concrete floor and to apply steady downward pressure to the concrete floor via the straight edge. The riding trowel is driven on the concrete floor and the straight edge is moved along the concrete floor simultaneously with the riding trowel.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
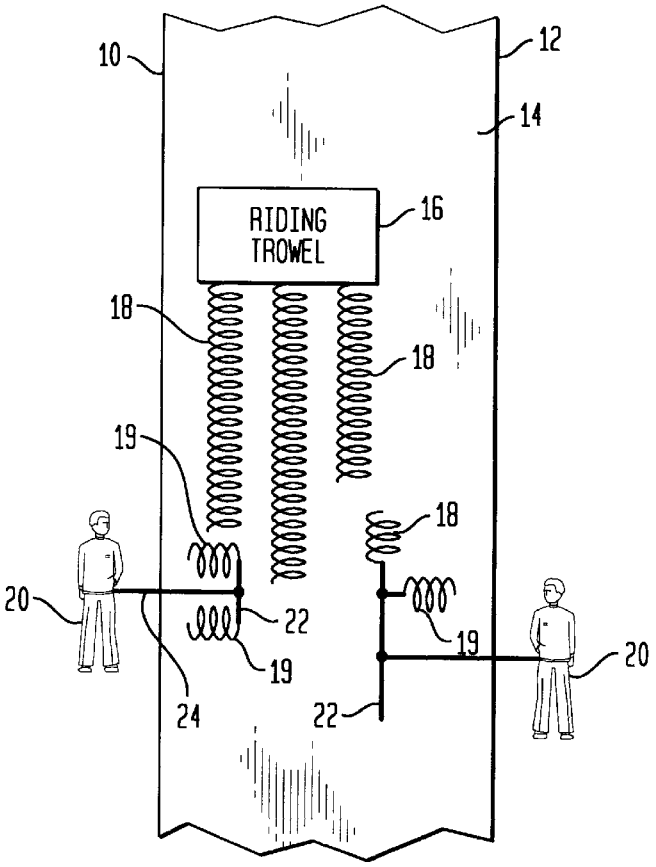
FIG. 1 (PRIOR ART)
FIG. 1 is schematic view depicting one method of finishing a concrete strip in accordance with the prior art.
Figure 2:
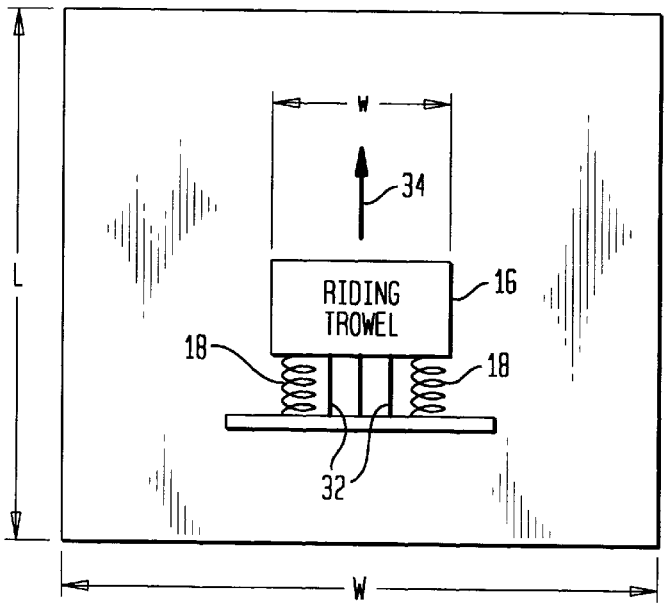
FIG. 2 is schematic view depicting one method of finishing a concrete floor in accordance with the present invention.

Referring now to the drawings, and more particularly to FIG. 2, a schematic view depicting the finishing of a concrete floor in accordance with the present invention is shown. Although the present invention can be used on both narrow-width and wide-width concrete floors, it is assumed for purpose of description that concrete floor 100 is poured to a width W that is in excess of 50 feet. The length L of concrete floor 100 is not a limitation of the present invention. It is further assumed for purposes of the present invention that concrete floor 100 has achieved a level of hardness such that only the top layer of approximately ⅛ to 3⁄16 of an inch is still plastic. Accordingly, concrete floor 100 is capable of receiving thereon a standard riding trowel as described above in the Background. However, in the present invention, the riding trowel has been improved in order to carry out an improved method of finishing.

As shown in FIG. 2, a conventional riding trowel 16 has a single straight edge 30 coupled thereto by a support and positioning assembly 32. Straight edge 30 is held by assembly 32 such that it is in close proximity to riding trowel 16 and in the line-of-sight of the operator of riding trowel 16. In this way, when straight edge 30 is positioned by assembly 32 on concrete floor 100, the operator can use straight edge 30 to clearly see the high areas of concrete floor 100 that must be cut and the low areas of concrete floor 100 that must be filled. This improves the efficiency of the cut/fill operation because the operator can see for himself which areas of concrete floor 100 must be stirred up by riding trowel 16 prior to being cut down.

Further, as riding trowel 16 is driven in a direction of travel, indicated by arrow 34, one or more windrows 18 of loosened concrete material are formed in the wake of riding trowel 16. For example, windrows 18 are most prominent at the outside edges of riding trowel 16 when overlapping blades (not shown) are mounted thereon. In the case of riding trowel 16 equipped with non-overlapping pans, the most prominent windrow is formed at the center of the riding trowel between the pans.

Straight edge 30 is a single straight edge that extends beyond the width w of riding trowel 16 (e.g., by approximately 2 feet on either side of riding trowel 16) as viewed relative to direction of travel 34. By use of support and positioning assembly 32, straight edge 30 is positioned on concrete floor 100 perpendicular (or substantially perpendicular) to and crossing each of windrows 18. As riding trowel 16 moves along in direction of travel 34, straight edge 30 is thus dragged simultaneously and in correspondence with riding trowel 16. The length of straight edge 30 and its angular relationship with respect to windrows 18 means that windrows 18 can be cut, smoothed and dispersed within the confines of straight edge 30. This prevents the creation of subsequent windrows at the outboard ends of straight edge 30. Further, since all windrows 18 are being cut, smoothed and dispersed immediately after their creation, the prior art problem of windrow hardening is avoided. In addition, no worker need set foot on concrete floor 100 in order to finish same. Regardless of the position of riding trowel 16 on concrete floor 100 or the type of blade assemblies (not shown) used by riding trowel 16, straight edge 30 is always optimally placed to cut, smooth and disperse the trowel-formed windrows.

Figure 3:
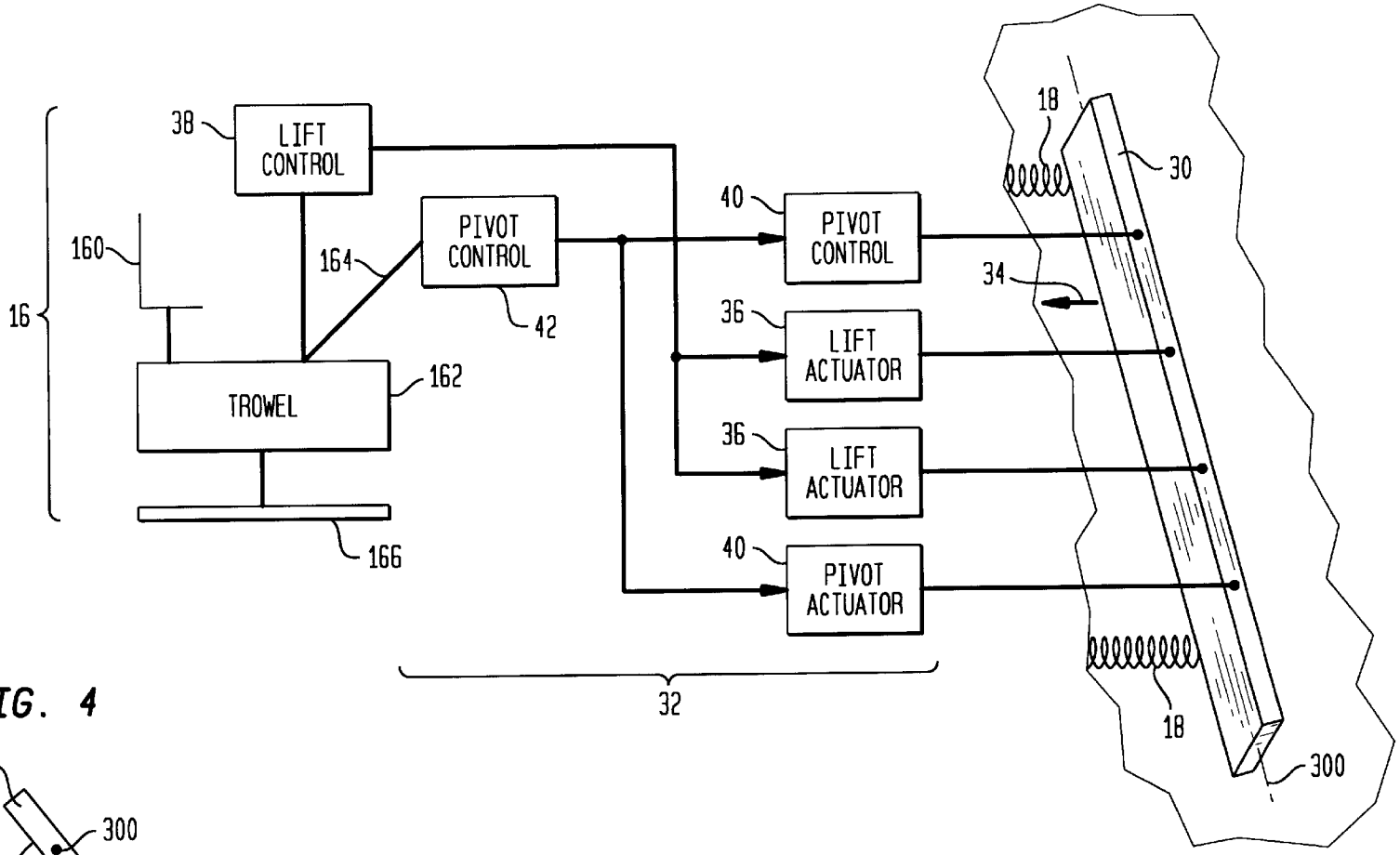
FIG. 3 is schematic view of the power bump cutting system for use with a riding trowel in accordance with the present invention.

A schematic view of a power bump cutting system and resulting improved riding trowel is shown in FIG. 3 in order to illustrate the essential features of the present invention.

Riding trowel 16 is of the type having an operator seat 160 disposed on the top of its frame 162 with steering controls, e.g., steering control arms 164, in proximity of seat 160 for easy manipulation by an operator sitting on seat 160. Riding trowel 16 further has one or more rotating assemblies 166 supported beneath frame 162 for contacting/finishing a concrete floor. Steering control arms 164 manipulate rotating assemblies 166 to control the direction of travel of riding trowel 16.

As mentioned above, straight edge 30 is coupled to riding trowel 16 by supporting and positioning assembly 32. In general, assembly 32 functions to position straight edge 30 on concrete floor 100 in such a way that straight edge 30 will cross each windrow 18 formed by riding trowel 16 at a substantially right angle thereto as explained above. To position straight edge 30 on concrete floor 100, and further to apply a steady or even amount of downward pressure on concrete floor 100 via straight edge 30, a plurality of lift actuators 36 are coupled to straight edge 30 in distributed fashion along its length. Lift actuators 36 are mechanically coupled between riding trowel 16 and straight edge 30 for vertical movement of straight edge 30 with respect to concrete floor 100 and for application of downward pressure on concrete floor 100. Control of all lift actuators 36 is accomplished by a lift control 38 mounted in proximity to (or on) one of steering control arms 164 so that the operator can raise and lower straight edge 30 while maintaining his or her grasp on steering control arms 164.

Figure 4:
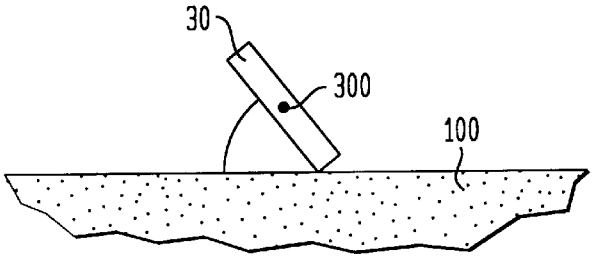
FIG. 4 is an isolated schematic view of the straight edge of the present invention pivoted at an angle with respect to the concrete floor.

For optimum cutting, filling and smoothing operations, straight edge 30 is pivotable about its central longitudinal axis which is represented in the figures by dashed line 300. More specifically, straight edge 30 is positioned perpendicular to concrete floor 100 for cutting high areas or pivoted to form an acute angle a with concrete floor 100 (FIG. 4) for pushing or dragging excess concrete material. Accordingly, a plurality of pivot actuators 40 are mechanically coupled to straight edge 30 for pivoting straight edge 30 about axis 300 to the desired position. It is desired to raise and lower straight edge 30 independently of the pivoting motion thereof in order to maintain an optimum angle on straight edge 30. Therefore, a separate pivot control 42 is mounted in proximity to (or on) one of steering control arms 164 so that the operator can pivot straight edge 30 while grasping steering control arms 164.

Figure 5:
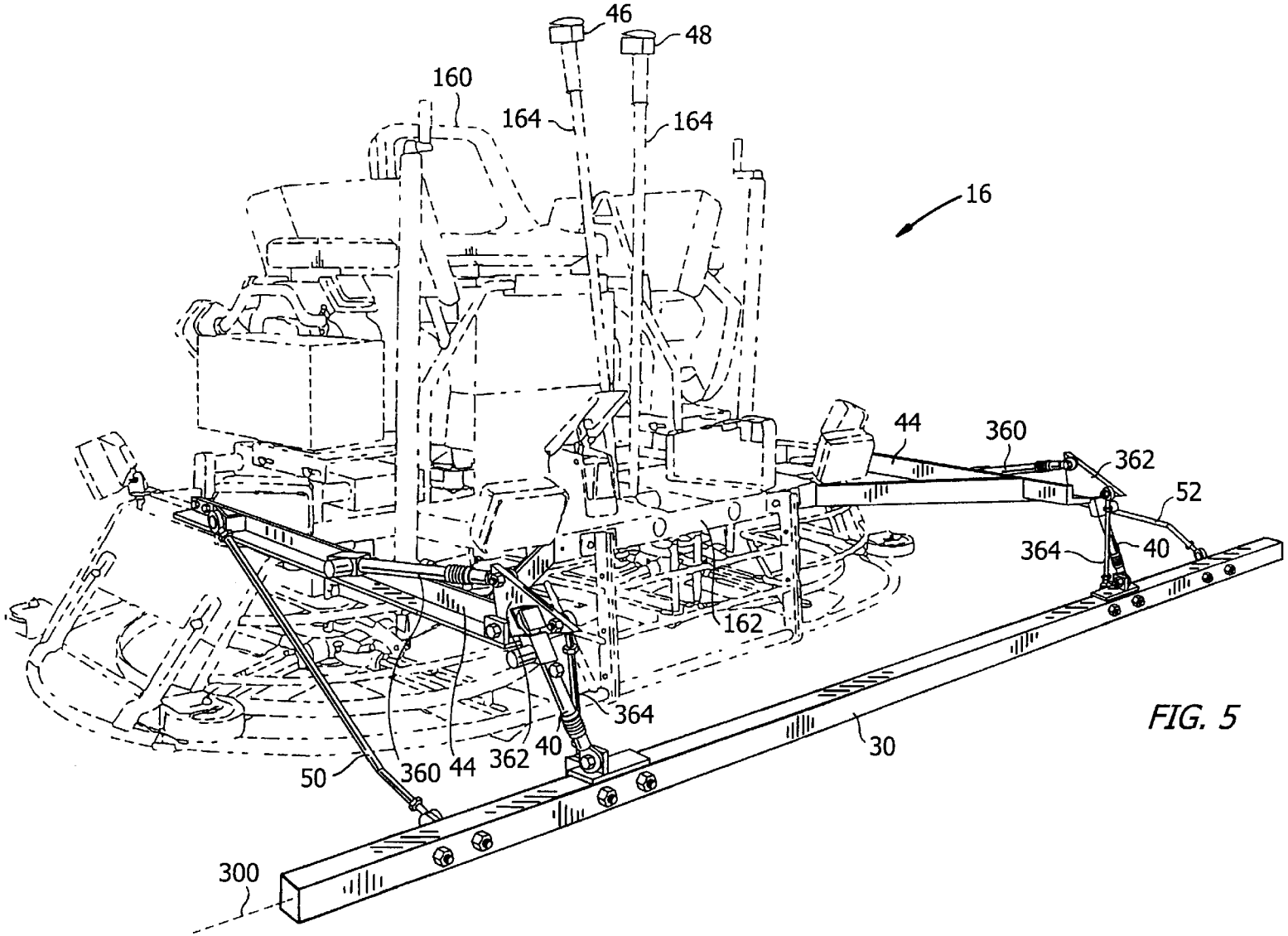
FIG. 5 is a perspective view of one embodiment of the power bump cutting system and resulting improved riding trowel according to the present invention.
Figure 6:
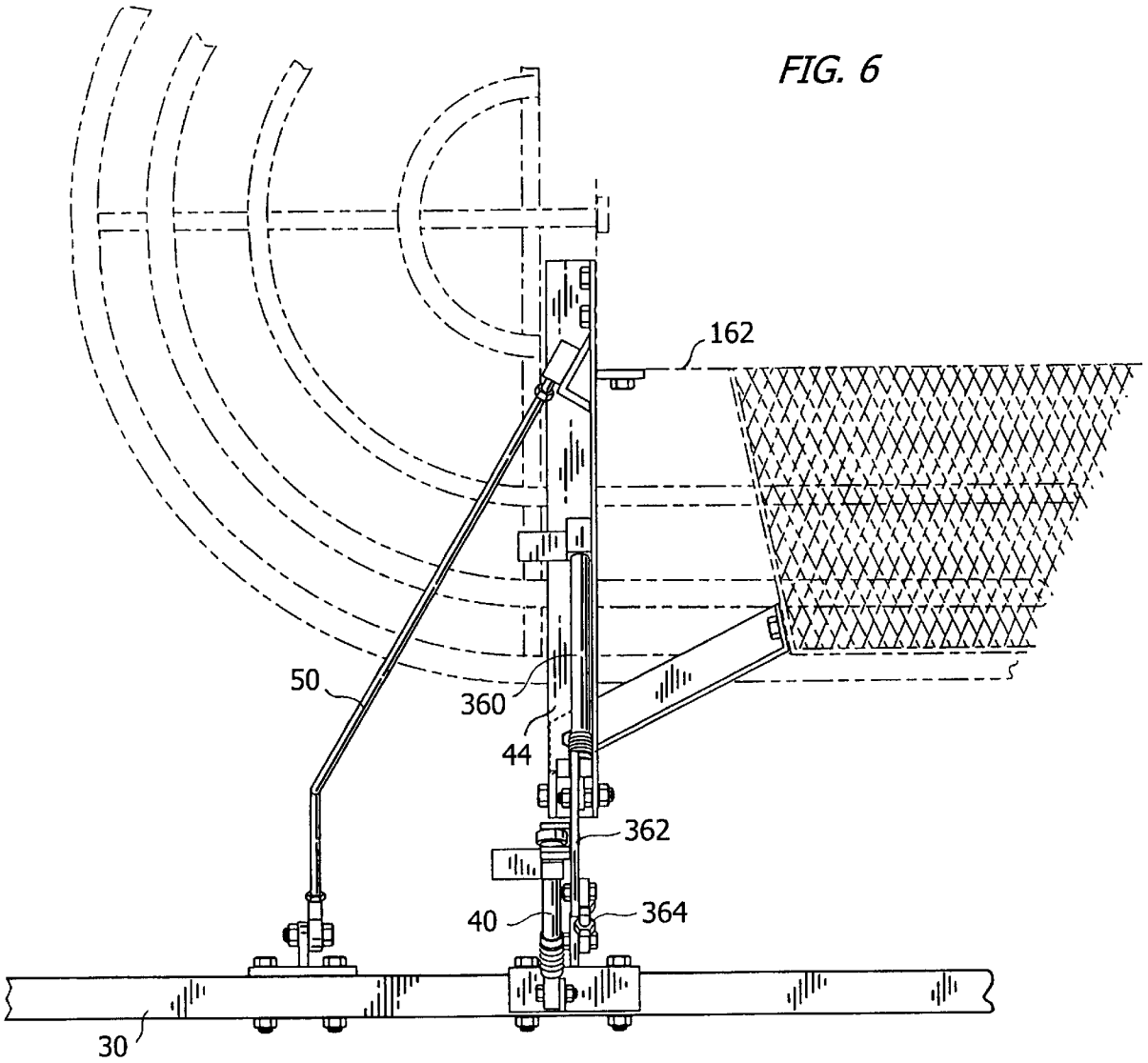
FIG. 6 is a top view of one side of the support and positioning assembly of the embodiment shown in FIG. 5.
Figure 7:
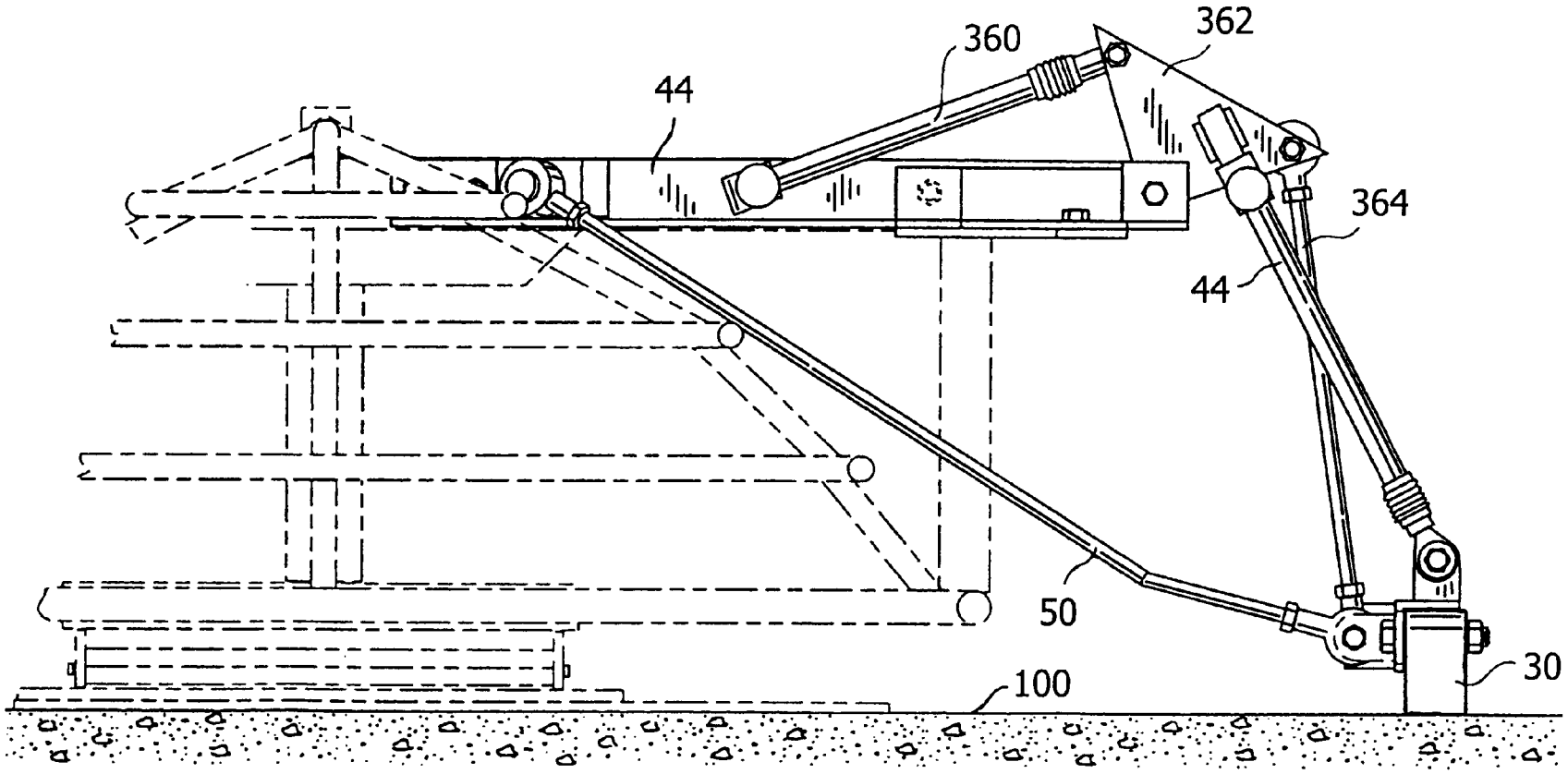
FIG. 7 is a side view of the support and positioning assembly of the embodiment shown in FIG. 5.

While the advantages of the present invention can be realized in a variety of embodiments, one proven power bump cutting system construction and resulting improved riding trowel will now be described with simultaneous reference to FIGS. 5–7. Common reference numbers will be used for those elements shown and described earlier herein. For clarity of illustration, the conventional riding trowel 16 is depicted in dashed line form. Riding trowel 16 is available commercially from a variety of manufactures such as Allen Engineering Incorporated, Paragould, Ark.; Bartell, Batavia, N.Y.; Stone Manufacturing, Honeoye, N.Y.; Stow Manufacturing, Binghamton, New York; and Whiteman Power Trowels, Carson, Calif.

Fixedly attached (e.g., bolted) to frame 162 are cantilevered frame extensions 44. Frame extensions 44 provide a stable platform to couple the lift and pivoting actuator assemblies to frame 162 so that straight edge 30 can be placed in the line-of-sight of an operator sitting on seat 160. For raising, lowering and applying downward pressure to straight edge 30, each lift actuator 36 (FIG. 3) can be realized by the combination of a linear actuator 360, pivot plate 362 and lift rod 364. Linear actuator 360 is fixedly coupled to frame extension 44 and pivotally coupled to pivot plate 362. Pivot plate 362 is pivotally coupled to frame extension 44. Lift rod 364 is a rigid rod pivotally coupled (e.g., with a heim joint) at either end thereof to pivot plate 362 and straight edge 30, respectively. To raise straight edge 30 vertically, linear actuator 360 is retracted which causes pivot plate 362 to rotate back towards riding trowel 16 which, in turn, causes lift rod 364 to raise straight edge 30. To lower or apply downward pressure to straight edge 30, linear actuator 360 is extended which causes pivot plate 362 to rotate away from riding trowel 16, which, in turn, causes lift rod 364 to lower or apply downward pressure along straight edge 30. It is important for lift rod 360 to be pivotally coupled to straight edge 30 to allow its simultaneous and/or independent pivoting movement as will now be described.

To pivot straight edge 30 about its central longitudinal axis 300, each pivot actuator 40 (FIG. 3) can be a linear actuator coupled between pivot plate 362 and straight edge 30. More specifically to the embodiment in FIGS. 5–7, pivot actuator 40 is fixed at one end thereof to pivot plate 362 and pivotally coupled (e.g., with a heim joint) to straight edge 30. Straight edge 30 is pivoted about axis 300 when linear actuator 40 is extended or retracted. Since pivot actuator 40 is coupled to part of the assembly that forms lift actuator 36, the pivot angle set by pivot actuator 40 will remain constant as straight edge 30 is raised, lowered or pressed downward.

Control of linear actuators 360 and 40 can be accomplished by an operator sitting in operator seat 160. For the illustrated embodiment, rocker switches 46 and 48 are mounted atop each of steering control arms 164. Rocker switch 46 is electrically coupled to linear actuators 360 for controlling their simultaneous retraction or extension to raise or lower straight edge 30. Rocker switch 48 is electrically coupled to linear (pivot) actuators 40 for controlling their simultaneous retraction or extension.

While the actuator assemblies described above provide a certain degree of support along straight edge 30, additional supports can be provided along the length of straight edge 30 in order to help maintain its longitudinal rigidity. Toward this end, a plurality (two are shown) of rigid support arms 50 and 52 are coupled between riding trowel 16 and straight edge 30. More specifically, in the illustrated embodiment, each of support arms 50 and 52 is pivotally attached at one end thereof to frame 162 and at the other end thereof to straight edge 30. The pivotal coupling of support arms 50 and 52 is necessary to allow them to float with the vertical and/or pivoting movement of straight edge 30.

The advantages of the present invention are numerous. Wide pour concrete floors finished in accordance with the present invention have achieved flatness readings of F(F) 75. This is an order of magnitude improvement over the results achievable by prior art methods and systems. The savings in manpower relates to a floor-finishing cost savings of as much as $1 per square foot of placed concrete. The present invention also reduces construction time as larger pours can be utilized and finished more quickly to higher F-number standards than ever before. The expense and problems brought on by manual bump cutting are completely eliminated by the present invention. Windrow hardening complications brought on by environmental conditions are also completely eliminated. After years of waiting, concrete floor finishing can finally keep pace with the amounts of concrete that can be poured.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by letters patent of the united states is:

1. A method of finishing a concrete floor that exceeds approximately 50 feet in width, comprising the steps of:

positioning a riding trowel on said concrete floor;

driving said riding trowel on said concrete floor in a direction of travel wherein a windrow of loosened concrete material is formed in the wake of said riding trowel along said direction of travel;

coupling a straight edge to said riding trowel for corresponding movement with said riding trowel in said direction of travel, wherein said straight edge has a central longitudinal axis maintained substantially parallel to said concrete floor;

positioning said straight edge on said concrete floor from said riding trowel so that said straight edge crosses said windrow at a substantially perpendicular angle thereto;

pivoting said straight edge about said central longitudinal axis to a desired position from said riding trowel; and applying an independent continuously controllable downward pressure from said riding trowel along said straight edge pivoted to said desired position, wherein said straight edge smoothes said windrow during said step of driving.

2. A method according to claim 1 wherein said steps of driving positioning said straight edge, pivoting and applying are controlled by a single operator onboard said riding trowel.

3. A power bump cutting system for a riding trowel having an operator seat and steering controls disposed in proximity of said operator seat such that an operator sitting on said operator seat can easily manipulate said steering controls, said riding trowel forming a windrow of loosened concrete material in the wake of said riding trowel that is driven by said operator in a direction of travel, said bump cutting system comprising:

a straight edge having a central longitudinal axis;

a support assembly coupling said straight edge to said riding trowel, said support assembly positioning said straight edge substantially parallel with said concrete floor to cross said windrow at a substantially perpendicular angle thereto within line-of-sight of said operator sitting on said operator seat, said support assembly simultaneously maintaining longitudinal rigidity of said straight edge, permitting vertical movement of said straight edge relative to said concrete floor, and permitting pivoting movement of said straight edge about said central longitudinal axis;

a power assembly coupled between said straight edge and said riding trowel for independently controlling said vertical movement and said pivoting movement to position said straight edge relative to a concrete floor and to apply steady downward pressure to said concrete floor via said straight edge as said riding trowel is driven over said concrete floor in said direction of travel, wherein said straight edge smooths said windrow;

a first switch control mounted in proximity to said steering controls such that said operator can operate said first switch control while grasping said steering controls, said first switch control coupled to said power assembly for controlling said vertical movement; and a second switch control mounted in proximity to said steering controls such that said operator can operate said second switch control while grasping said steering controls, said second switch control coupled to said power assembly for controlling said pivoting movement.

4. A system as in claim 3 wherein said support assembly comprises a plurality of rigid support arms, each of said plurality of rigid support arms being pivotally coupled on one end thereof to said straight edge and pivotally coupled on another end thereof to said riding trowel.

5. A system as in claim 4 wherein said plurality of rigid support arms are distributed along the length of said straight edge.

6. A system as in claim 3 wherein said power assembly comprises:

a first plurality of actuators coupled between said riding trowel and said straight edge such that movement of said first plurality of actuators causes said vertical movement; and a second plurality of actuators coupled between said first plurality of actuators and said straight edge such that movement of said second plurality of actuators causes said pivoting movement.

7. A system as in claim 3 wherein said steering controls include a first steering control arm grasped by one hand of said operator and a second steering control arm grasped by the other hand of said operator, and wherein said first switch control comprises a first rocker switch mounted on said first steering control arm and said second switch control comprises a second rocker switch mounted on said second steering control arm.

8. A system as in claim 3 wherein said straight edge is a single straight edge extending beyond the width of said riding trowel.

9. An improved trowel system for finishing a concrete floor that exceeds approximately 50 feet in width, said improved trowel system comprising:

a riding trowel having a frame supporting an operator seat and operator controls on a top side thereof and supporting a plurality of rotating assemblies from a bottom side thereof for contacting and finishing said concrete floor, said riding trowel forming a windrow of loosened concrete material in the wake of said riding trowel moving in a direction of travel;

a straight edge having a central longitudinal axis; and an assembly coupling said straight edge to said frame, said assembly positioning said straight edge substantially parallel with said concrete floor to cross said windrow at a substantially perpendicular angle thereto within line-of-sight of an operator sitting on said operator seat, simultaneously maintaining longitudinal rigidity of said straight edge, permitting vertical movement of said straight edge relative to said concrete floor, permitting pivoting movement of said straight edge about said central longitudinal axis, independently controlling said vertical movement and said pivoting movement to position said straight edge relative to a concrete floor and to apply steady downward pressure to said concrete floor via said straight edge as said riding trowel is driven over said concrete floor in said direction of travel, wherein said straight edge smooths said windrow in the wake of said riding trowel moving in said direction of travel.

10. An improved trowel system as in claim 9 wherein said assembly comprises:

each of a first plurality of rigid support arms fixed to said frame and cantilevered therefrom;

each of a second plurality of rigid support arms pivotally coupled on one end thereof to said straight edge and pivotally coupled on another end thereof to one of said first plurality of rigid support arms;

each of a first plurality of actuator assemblies coupled between one of said first plurality of rigid support arms and said straight edge for controlling said vertical movement; and each of a second plurality of actuator assemblies coupled between of one of said first plurality of actuator assemblies and said straight edge for controlling said pivoting movement.

11. An improved trowel system as in claim 10 wherein said second plurality of rigid support arms are distributed along the length of said straight edge.

12. An improved trowel system as in claim 10 wherein said operator controls comprises steering controls that can be easily manipulated from said operator seat, said improved trowel system further comprising:

a first switch control mounted in proximity to said steering controls such that said operator can operate said first switch control while grasping said steering controls, said first switch control coupled to each of said first plurality of actuator assemblies for controlling said vertical movement; and a second switch control mounted in proximity to said steering controls such that said operator can operate said second switch control while grasping said steering controls, said second switch control coupled to each of said second plurality of actuator assemblies for controlling said pivoting movement.

13. An improved trowel system as in claim 10 wherein said straight edge is a single straight edge extending beyond the width of said riding trowel.

* * * * *